US011046565B2

(12) United States Patent
Krulitsch et al.

(10) Patent No.: US 11,046,565 B2
(45) Date of Patent: Jun. 29, 2021

(54) FILLING APPARATUS

(71) Applicant: KHS GmbH, Dortmund (DE)

(72) Inventors: Dieter-Rudolf Krulitsch, Bad Kreuznach (DE); Ludwig Clüsserath, Bad Kreuznach (DE); Bernd Bruch, Weinsheim (DE)

(73) Assignee: KHS GmbH, Dortmund (DE)

( * ) Notice: Subject to any disclaimer, the term of this patent is extended or adjusted under 35 U.S.C. 154(b) by 0 days.

(21) Appl. No.: 16/958,425

(22) PCT Filed: Nov. 16, 2018

(86) PCT No.: PCT/EP2018/081505

§ 371 (c)(1),
(2) Date: Jun. 26, 2020

(87) PCT Pub. No.: WO2019/137666

PCT Pub. Date: Jul. 18, 2019

(65) Prior Publication Data

US 2020/0346913 A1 Nov. 5, 2020

(30) Foreign Application Priority Data

Jan. 9, 2018 (DE) ..... 102018100353.6

(51) Int. Cl.
*B67C 3/26* (2006.01)
*B67C 3/00* (2006.01)
*B67C 3/22* (2006.01)

(52) U.S. Cl.
CPC ..... *B67C 3/26* (2013.01); *B67C 3/007* (2013.01); *B67C 3/225* (2013.01); *B67C 2003/2668* (2013.01)

(58) Field of Classification Search
CPC ..... B67C 3/26; B67C 3/007; B67C 3/225; B67C 2003/2668
(Continued)

(56) References Cited

U.S. PATENT DOCUMENTS 5,217,050 A * 6/1993 Varlet ..... B05B 11/0097 141/2
6,378,574 B2 * 4/2002 Tsutsui ..... B65B 3/32 137/146
(Continued)

FOREIGN PATENT DOCUMENTS

DE 191261 C 8/1907
DE 9303698 U1 4/1994
(Continued)

*Primary Examiner* — Timothy L Maust
(74) *Attorney, Agent, or Firm* — Occhiuti & Rohlicek LLP

(57) ABSTRACT

A filling machine for pressure-filling containers includes a container receptacle arranged beneath the filling element, a first lift that vertically adjusts the filling element to accommodate different container sizes, a shield that adjusts relative to the filling element and comprises a single-piece partition and that, in a protection position, at least partially surrounds the container during filling thereof. An adjuster adjusts the shield and the receptacle relative to one another between a protection position and a release position by changing the receptacle's position relative to the shield in a region of a feeding-and-discharge device. The adjuster comprises at least one of a second lift and a rotation mechanism that rotates a container about a container axis thereof.

12 Claims, 8 Drawing Sheets

(58) Field of Classification Search
USPC ..... 141/144–148, 275–277
See application file for complete search history.

(56) References Cited

U.S. PATENT DOCUMENTS

| | | | | |
|---|---|---|---|---|
| 8,505,594 | B2 * | 8/2013 | Krulitsch | B67C 3/2608 141/104 |
| 10,040,677 | B2 * | 8/2018 | Clusserath | B67C 3/22 |
| 10,633,238 | B2 * | 4/2020 | Boscaro | B67C 3/225 |
| 2009/0120530 | A1 * | 5/2009 | Kelley | B65D 1/0261 141/8 |

FOREIGN PATENT DOCUMENTS

| | | | |
|---|---|---|---|
| DE | 102011110840 | A1 | 2/2013 |
| EP | 2246291 | A1 | 11/2010 |
| WO | 2013/026523 | A2 | 2/2013 |
| WO | 2015/091050 | A1 | 6/2015 |

* cited by examiner

FILLING APPARATUS

RELATED APPLICATIONS

This is the national stage of international application PCT/EP2018/081505, filed on Nov. 16, 2018, which claims the benefit of the Jan. 9, 2018 priority date of German application DE 102018100353.6, the contents of which are herein incorporated by reference.

FIELD OF INVENTION

The invention relates to container filling and in particular to filling glass bottles under pressure.

BACKGROUND

In container-filling machines that fill glass bottles under pressure, it is possible for a bottle to break by being filled. This causes shards of broken glass to be sprayed in all directions. To protect neighboring bottles from being broken and potentially initiating a catastrophic chain reaction, it is usual to have a shield around a filling position to intercept such shards before they can damage neighboring bottles.

The need for a shield is particularly important because the internal pressure in a bottle can be quite high. During hot filling of beverages having dissolved carbon dioxide, the pressure can reach beyond seven atmospheres. Should a bottle have a defect, it is quite likely to burst under such pressure.

A screening arrangement usually includes a partition plate that connects to a filling element. If the filling element is moved up or down to adjust to different bottle sizes, the partition plate will be either too long or too short. A disadvantage of this known technique, therefore, is that the shielding arrangement cannot effectively protect all bottle or container sizes.

SUMMARY

An object of the present invention is to shield the containers securely during filling, regardless of their size.

In one aspect, the invention features a filling machine for pressure-filling containers. The filling machine comprises a rotating transport element that comprises receiving stations, each of which includes a filling element, a first lift, a shield, an adjuster, and a container receptacle for a container, the container receptacle being arranged beneath the filling element. The first lift vertically adjusts the filling element in a vertical direction to accommodate different container sizes. The shield, which is formed at the receiving station, is adjustable relative to the filling element and comprises a single-piece partition that defines at least a portion of a cylinder. During filling of the containers, the shield is in a protection position in which it at least partially surrounds the container. The adjuster adjusts the shield and the container receptacle relative to one another between the protection position and a release position. It does so by changing a position of the container receptacle relative to the shield in a region of a feeding-and-discharge device. The feeding-and-discharge device is arranged in a conveying region of the transport element for feeding the container to the transport element and for receiving a container that has been discharged from the rotating transport element. The adjuster comprises either a second lift or a rotation mechanism, the latter being one that rotates the container about a container axis thereof.

In some embodiments, the shielding device is adjustable relative to the filling element. In this way, the shielding arrangement is decoupled from the filling element. Accordingly, if the filling element is adjusted at the beginning of the filling to a new type of bottle, namely to its size, by the first lift, the shielding arrangement is no longer coupled to it.

Accordingly, within the framework of the adjustment of the filling apparatus, the screening arrangement can be adjusted to a new container size relative to the filling element and, as appropriate, to the container receptacle, e.g. adjusted vertically and/or rotated, in such a way that the shielding arrangement surrounds the container in the filling position, at least partially circumferentially, preferably fully, but on the other hand does not collide with other parts of the filling apparatus.

Preferably, the container in the filling apparatus is covered towards the outside, such that, in the event of a bottle shattering during the filling process, the resulting shards, which are flung radially outwards, are trapped and cannot cause injury to personnel. With a circular filling machine. Preferably, the partition plate is formed as at least partially circular in such a way that it shields the container, in particular the bottle, laterally so that shards do not strike adjacent containers.

Accordingly, the shielding arrangement can, for example, be suspended from an upper carrying element of the filling apparatus, and the filling element is adjusted vertically in such a way that the shielding arrangement, in the filling position of the container, i.e. when the mouth of the bottle is in tight contact at the filling organ of the filling element, projects downwards as far as the container receptacle. The pressing of the container against the filling organ is then put into effect by a lower lift of the container receptacle within the framework of every filling procedure.

The invention has a number of advantages. The partition plate, for example, is no longer coupled to the filling element. In this way, independently of this element, it is possible, within the framework of the adjustment of the filling apparatus, for an adjustment to be made to the container size. As a result, no size-adjustable shielding arrangement is required for the shielding of containers of different sizes, but the shielding arrangement, for example a partition plate, can be selected in a size which completely shields the largest containers which are to be filled.

The screening arrangement preferably relies on a single-piece partition plate. This is more hygienic than a multi-part partition plate. The end result is reduced manufacturing costs, cleaning costs, and is overall hygiene.

The screening arrangement and the container receptacle or filling element can be adjusted relative to one another by an adjustment mechanism. The adjustment mechanism is configured such as to change the relative position of the container receptacle/filling element and of the shielding arrangement from a protective position into a release position.

A release of the containers from the transport element can be carried out in this situation in that, in the region of the feed/discharge device, the relative position of the shielding arrangement and container receptacle/filling element is changed by the adjustment mechanism in such a way that the containers are released. Such a movement can be a lifting movement between the shielding arrangement and the container receptacle or a rotation movement of the shielding arrangement relative to the container receptacle.

During the entire filling process, the shielding arrangement or the partition plate of a receiving station respectively is then in a protection position in which it surrounds the container at least in such a way that other containers are not damaged in the event of the container bursting during the pressure filling process.

According to the invention, the shielding arrangement contains or is a partition plate in the form of a semi-circle or full circle, which surrounds the container at least to outside, partially or in full circumference. In this way, a shielding arrangement can be realized which is space-saving but also provides optimum shielding for the container and also provides effective security for the space surrounding the circular filling machine as well as for the bottles in relation to one another.

The expressions "semi-circular" or "circular" relate to the cross-section profile of the cylindrical partition plate. Semi-circular/circular should also be understood to include a polygonal structure.

In a first advantageous embodiment of the invention, the adjustment mechanism is formed as at least one second lift that changes the vertical distance interval between the container receptacle and the shielding arrangement. It is possible in this embodiment either to lift the shielding arrangement and to hold the container receptacle at the same height level or to hold the shielding arrangement at the same height level and to lower the container receptacle. It is also possible for the upwards movement of the shielding arrangement to be combined with the downwards movement of the container receptacle, as a result of which the travel paths of both the elements can be kept shorter.

The vertical movement of the shielding arrangement and/or of the container receptacle in the region of the feeding or discharge device enables the containers to be released from the shielding arrangement, and therefore transferred into the transport element or removed from it respectively.

In some embodiments, the adjustment mechanism is a rotation mechanism that rotates the shielding arrangement, especially when it is configured as a semi-circular partition plate, about a vertical axis above the center of the container receptacle. The partition plates rotate in the filling region into a protection position, while in the region of the feed/discharge device they are rotated into a release position.

In some embodiments, the adjustment mechanism includes a second lift that includes an actuating cylinder to change the relative position of the container receptacle and of the shielding arrangement. In other embodiments, the lift includes a linear drive.

It is preferable, if the adjustment mechanism is configured as a second lift and for the shielding arrangement and/or the container receptacle to be conveyed at a vertical guide such that they can be easily moved in relation to one another by the at least one second lift.

In an advantageous embodiment of the invention, the second lift is coupled to a return gas tube, which is adjustable independently of the filling element, in order to cause the simultaneous vertical movement of this element. In this way, fewer components are required in order to adjust the different elements of the filling apparatus, since the return gas tube and the shielding arrangement can be actuated by a common lift.

The lifts of the filling apparatus can in particular be configured as hydraulic or pneumatic actuating cylinders or as linear drives. Such drives are reliable and economical.

The invention likewise relates to a method for the filling of containers in a filling apparatus with a moved transport element, in particular a revolving transport element of a circular filling machine. It may also relate, however, to a linear transport element with a corresponding conveying mechanism, e.g. a circulating conveyor element. The transport element has receiving stations with container receptacles for the containers and arranged in the conveying region of the transport element is at least one feed/discharge device for the feed and discharge of the containers into/out of the transport element. Such a feed/device is formed preferably from a feed star and a discharge star.

Each container receptacle, e.g. a setting plate, is arranged in a receiving station beneath an associated filling element, wherein the filling element is adjustable vertically in order to adapt to containers of different sizes by a first lift. Each receiving station comprises at least one shielding arrangement, as a rule at least one partition plate, which during the filling at least partially surrounds the container in a protection position. According to the invention, in order to adapt the filling apparatus to a new container type of a different size the position of the shielding arrangement relative to the filling element. The relative position of the shielding arrangement to the filling element is therefore adjustable in such a way that, when the container is in contact at the filling organ of the filling element, the shielding arrangement completely covers the container, e.g. extends downwards as far as the container receptacle.

Preferably, the relative position between the shielding arrangement and container receptacle is moved by an adjustment mechanism, in particular in the region of the feed and discharge device, between the protection position and a release position. With regard to the advantages of this method, reference is made to the description of the filling apparatus according to the invention.

Advantageously, the shielding arrangement and the container receptacle are moved vertically and/or rotated relative to one another between the protection position and the release position by the adjustment mechanism. By both types of movement, a container can be brought from the protection position of the shielding arrangement or of the partition plate respectively into its release position, such that, in the region of the feed/discharge device, it can be transferred into the transport element or removed from it. The method is advantageously carried out in connection with a filling apparatus of the type referred to heretofore.

Embodiments further include combinations of the foregoing features.

The invention makes particularly practical sense for use with glass bottles which, in the context of pressure filling with CO2, could shatter due to material defects or thermal stresses, wherein the shards could potentially lead to a shattering or breaking of the adjacent bottles. Due to the configuration according to the invention of the filling apparatus this is effectively eliminated, and specifically for all sizes of bottles.

The following terms are used in the application as synonyms: Filling apparatus—filling machine—circular filling machine; adjustment mechanism—second lift—rotation mechanism; shielding arrangement—partition plate; container—bottle—glass bottle; transport element—circulating transport element; runner—guide roller; return gas tube—trinox tube.

BRIEF DESCRIPTION OF THE DRAWINGS

The invention is described hereinafter by way of examples, on the basis of the schematic drawings. These show.

DETAILED DESCRIPTION

Figure 1:
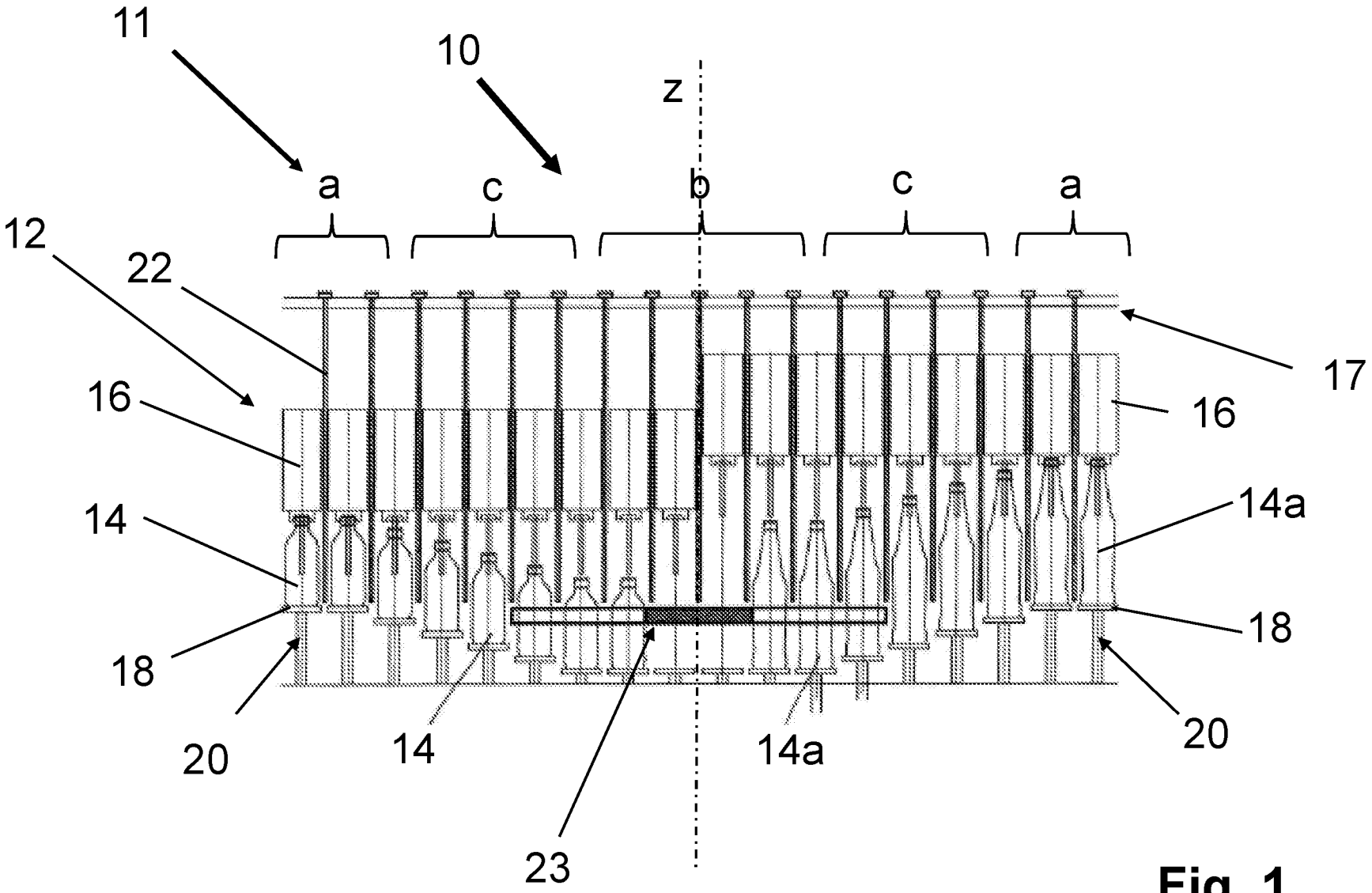
FIG. 1 shows a filling machine with fixed partition plates and a vertically removable container receptacle.
Figure 2:
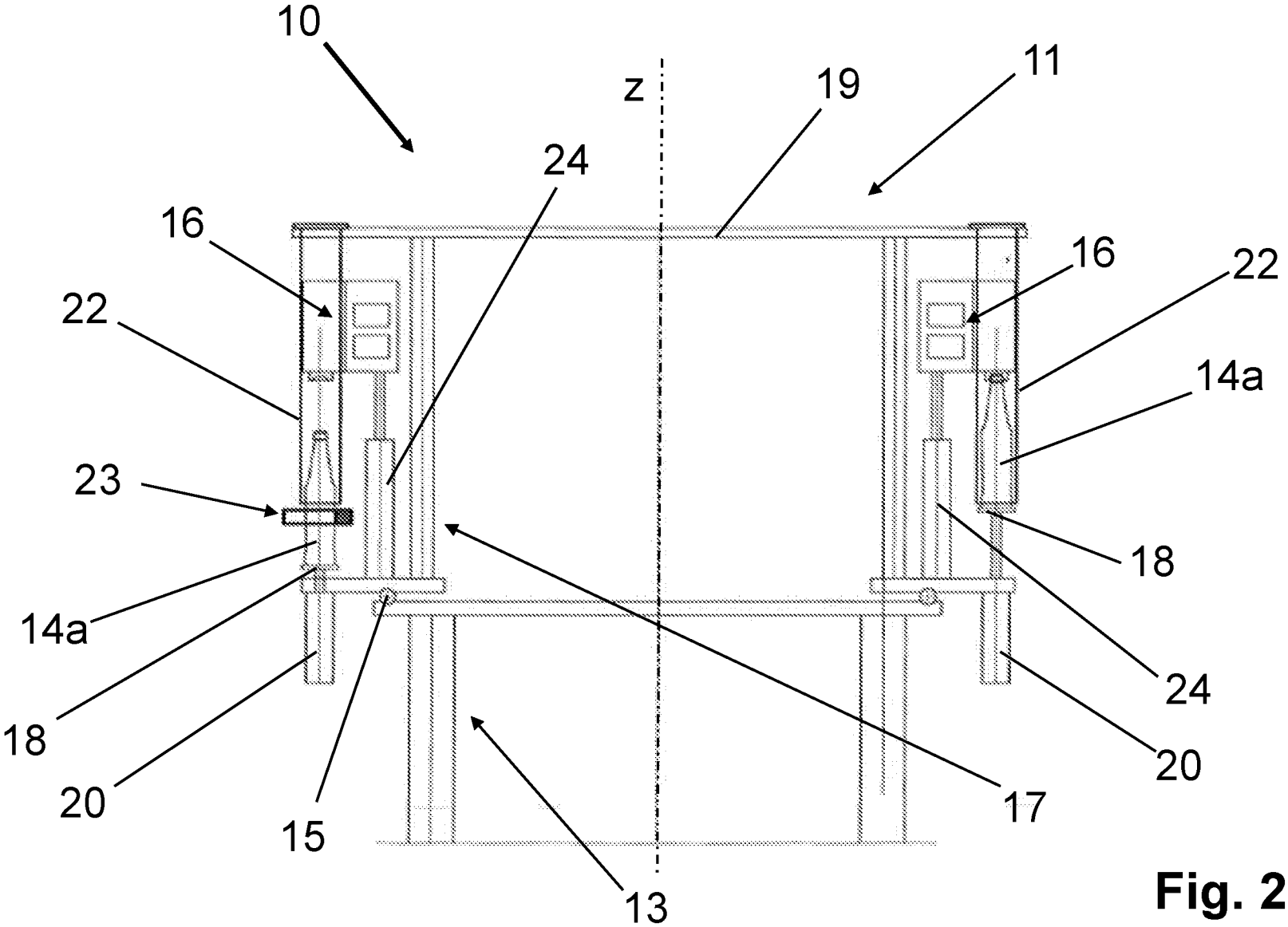
FIG. 2 is a section of the filling machine in FIG. 1 showing the protection position and release position of the partition plates.

FIGS. 1 and 2 show a side view and a section view, respectively, of a first embodiment a circular filling machine 10. The left half of FIG. 1 shows the operation of the filling machine 10 with small bottles 14. The right half of FIG. 1 shows the filling machine 10 in operation with large bottles 14*a*.

Referring now to FIG. 2, the filling machine 10 has a fixed carrier frame 13 and a rotating frame 17 with an upper carrier element 19. A rotary bearing 15, also shown in FIG. 2, permits the rotating frame 17 to rotate.

The rotating frame 17 forms a transport element 11 that rotates about a central axis z. This transport element 11 comprises, at its circumference, receiving stations 12 for the glass bottles 14. Each receiving station 12 has an associated filling element 16 and a container receptacle 18, an example of which is a receptacle plate. Each receiving station 12 also has a partition 22 suspended on an upper carrier element 19 of the circular filling machine. The partition 22 is a plate that functions as an associated shielding arrangement.

Each filling element 16 has a filling organ through which filling material passes as it enters the bottle during the filling process.

The filling machine includes a lower lift 20 and an upper lift 24.

The lower lift 20 raises or lowers the bottle 14 to press its mouth tightly against the filling organ during the filling process. It does so by adjusting the container receptacle 18. This forms the adjustment mechanism for a protection and release position of the partition 22. A suitable embodiment of the lower lift 20 is a hydraulic or pneumatic actuating cylinder or electrical spindle drive.

The upper lift 24 vertically adjusts the filling element 16 to accommodate different container sizes. A suitable example of an upper lift 24 is a hydraulic or pneumatic cylinder. This upper lift 24 presses the filling element 16, and in particular, the filling organ, tightly against the bottle's mouth.

In its protecting position, the partition 22 completely surrounds the bottle 14 as far downwards as the container receptacle 18, as shown in region "a." Filling takes place while the partition 22 is in this position.

Figure 3:
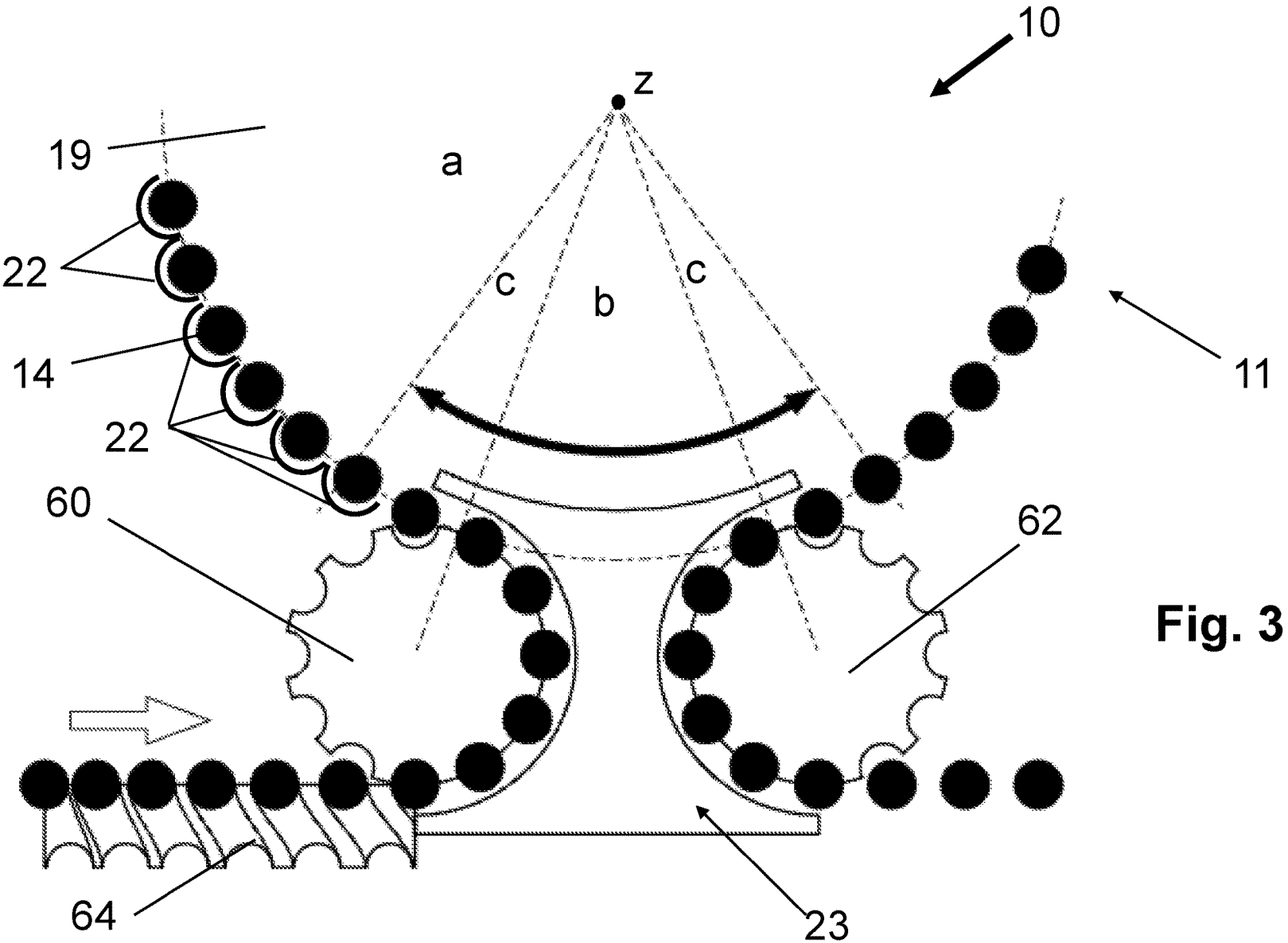
FIG. 3 shows the transport element of FIGS. 1 and 2 interacting with a feed/discharge device for the containers.

Referring now to FIG. 3, the filling machine 10 also includes a feed-and-discharge device 23. The feed-and-discharge device includes a feed star 60 and a discharge star 62 that are next to each other. The feed star 60 transfers empty bottles 14 into the transport element 11. The discharge star 62 removes filled bottles from the transport element 11.

To enable a bottle 14 to be loaded onto or removed from the transport device 11, the container receptacle 18 is lowered into the released position so that the bottles can be released from the partition 22. This takes place at region "b" in FIG. 3.

Referring back to FIG. 2, the upper lift 24 adjusts the filling element 16 vertically to accommodate bottles 14, 14*a*, that have different heights. Vertical actuation of the lower lift 20 moves the filling element 16 so that the lower edge of the partition 22 lies at approximately the level of the container base when the container 16 contacts the filling element's filling organ. At this point, the actual filling begins.

As a result of the foregoing, the partition 22 protects neighboring bottles from damage that would result from a bursting bottle. It does so regardless of the bottle's size. All that is required is that the lifting action of the lower lift 20 be adjusted differently for two bottles types 14, 14*a* independently of the upper lift 24, which is for the filling elements 16. This permits the filling machine 10 to accommodate different bottle sizes 14, 14*a* without the partitions 22 having to be converted to accommodate those different bottle sizes. It also avoids the hygiene problems that arise when using multipart adjustable partition elements.

The right side of FIG. 2 shows the bottle 14 in the filling position. The partition 22, which is in its protecting position, fully surrounds the bottle. In the illustrated embodiments, the partition 22 is cylindrical or semicylindrical form.

The left side of FIG. 2 shows the partition plate's release position. This would occur in the region of the transfer to the feed-and-discharge device 23. Typical embodiments also include various other systems that are in operative engagement with the filling machine 10. These include beverage-delivery systems, gas-delivery systems, and corresponding raw-material containers.

FIG. 3 shows a feed-and-discharge device 23 that interacts with the circulating transport element 11. The feeding-and-discharge device 23 includes a delivery star 60, a discharge star 62, and a transport worm 64 that feeds bottles to the delivery star 60. The delivery star 60 and the discharge star 62 cooperate to transfer a glass bottle 14 into the circulating transport element 11 and to remove the glass bottle 14 from the circulating transport element 11.

The partitions 22 extend along an angular range between 240° and 360° on the filling machine 10. In the illustrated embodiment, the partitions 22 are semicircular in cross section. As such, they shield the portion of the container's wall that faces radially outward.

Figure 4:
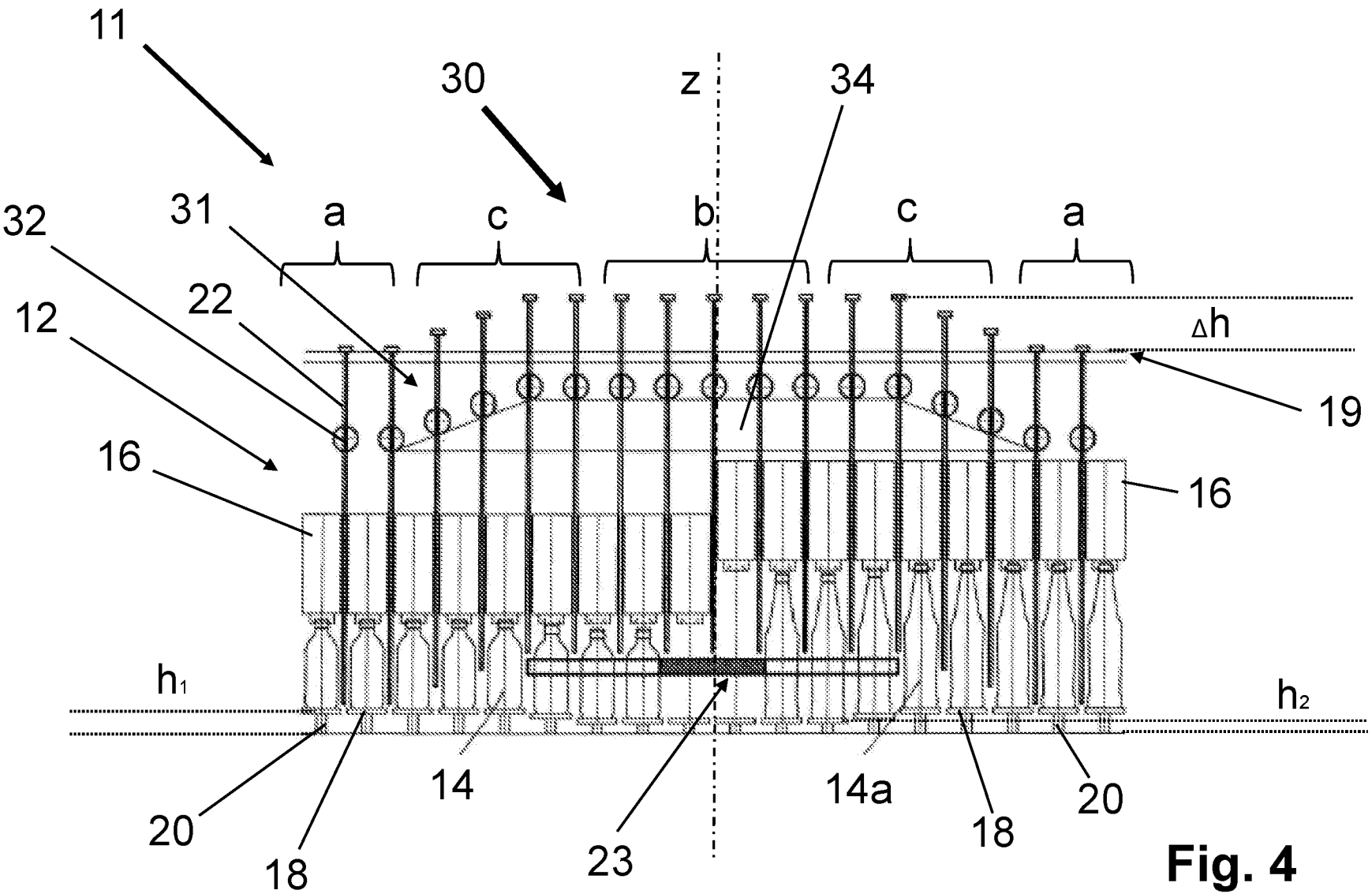
FIG. 4 shows another embodiment of a filling machine having vertically moved partition plates in the feed/discharge region.

In the transfer sector "b" between the delivery star 60 and the discharge star 62, the partitions 22 are completely in the release position. In the intermediate sectors "c," the partitions 22 moved relative to one another between the protection position and the release position, as can be seen in FIGS. 1 and 4. The relative movement takes place by lifting the container, lifting the receptacle, and/or rotating the partition 22.

FIG. 4 shows an alternative embodiment. In this second embodiment, the lower lift 20 adjusts the container receptacle 18 between a raised position h1 and a lowered position h2. This movement occurs in the region of the feed-and-discharge device 23.

The filling machine 10 features an upper lift 31 that includes a fixed ramp 34. In this embodiment, each partition 22 includes a runners or a guide roller 32 that rolls along the fixed ramp 34 in the region of the feed-and-discharge device 23.

In the embodiment of FIG. 4, the upper lift 31 raises the partitions 22 in the region of the feed-and-discharge device 23 by a height difference Δh. This permits delivery or removal of the bottles 14, 14*a*. The height of a bottle guide curve between the delivery star and discharge star 60, 62 limits the downward extension of partitions 22. During rotation of the filling circle 11, it is preferable that the partition 22 be above the feed-and-discharge device 23.

Like FIG. 1, FIG. 4 shows short bottles 14 on the left side and tall bottles 14*a* on the right side. This shows that different bottle sizes can be filled without having to carry out significant conversion work. Instead, all that needs to be done is for the lifting extent of the lower lift 20 or of the upper lift 31 to be adjusted accordingly. Such an adjustment can be carried out via software executing on the machine's control system. No hardware modification is required.

Figure 5:
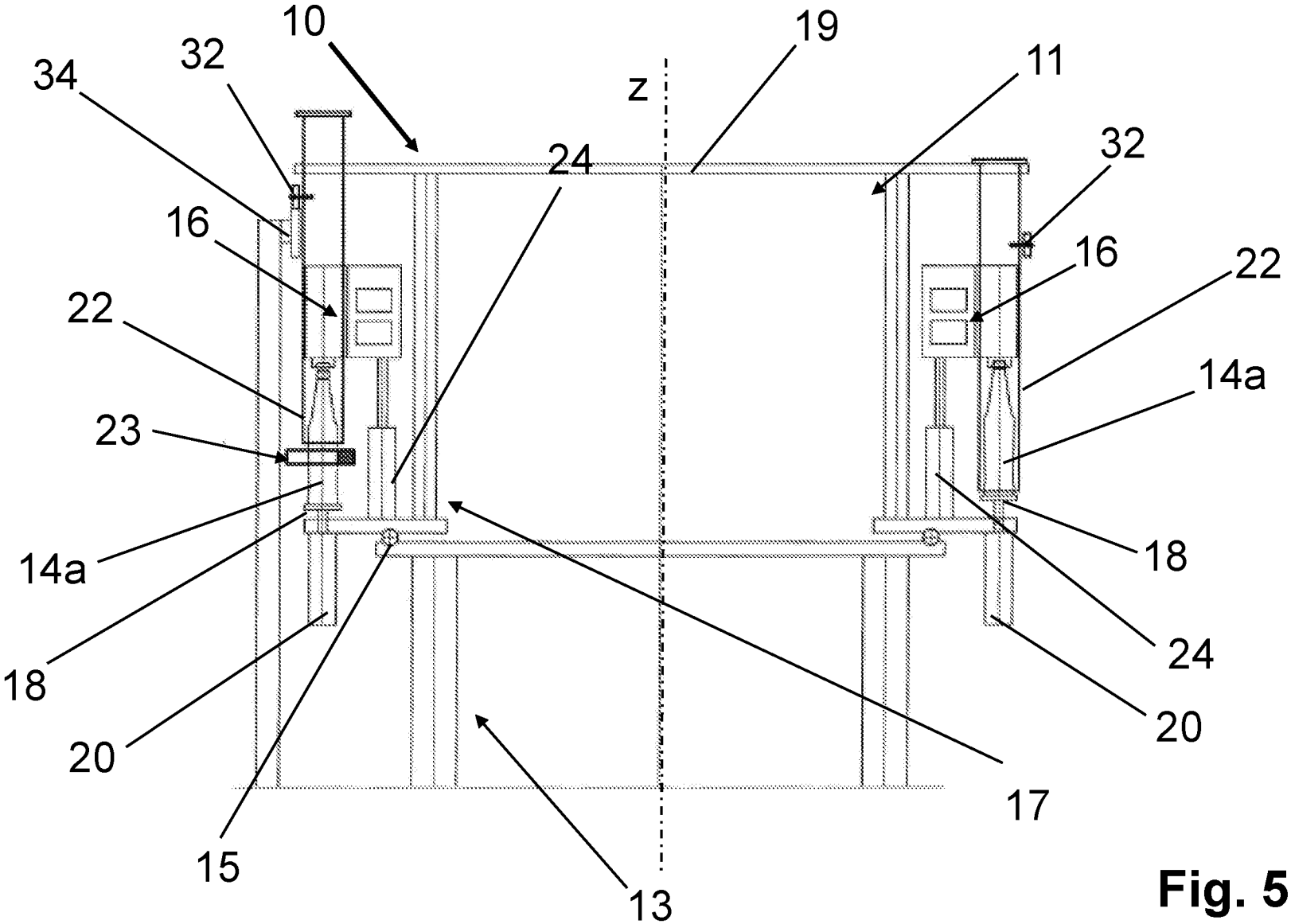
FIG. 5 shows a vertical section of the filling machine of FIG. 4 the protection position and release position of the partition plates.

FIG. 5 shows the cross-section view of the apparatus from FIG. 4. In both FIGS. 4 and 5, the lower and upper lifts 20, 31 form the adjustment mechanism for the protection position and release position of the partition 22.

Figure 6:
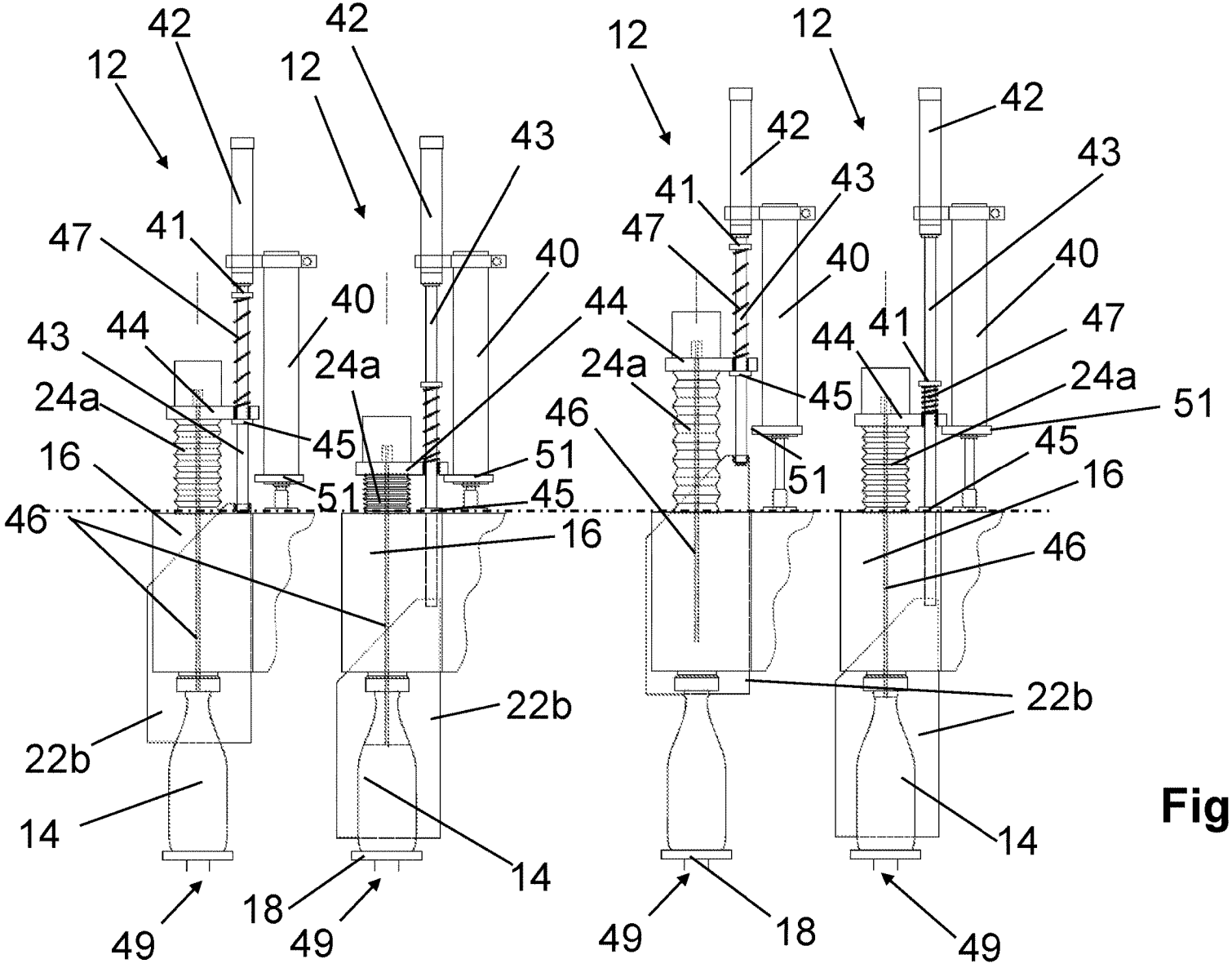
FIG. 6 shows an embodiment in which the partition plate couples to the lift for a return flow tube.
Figure 7:
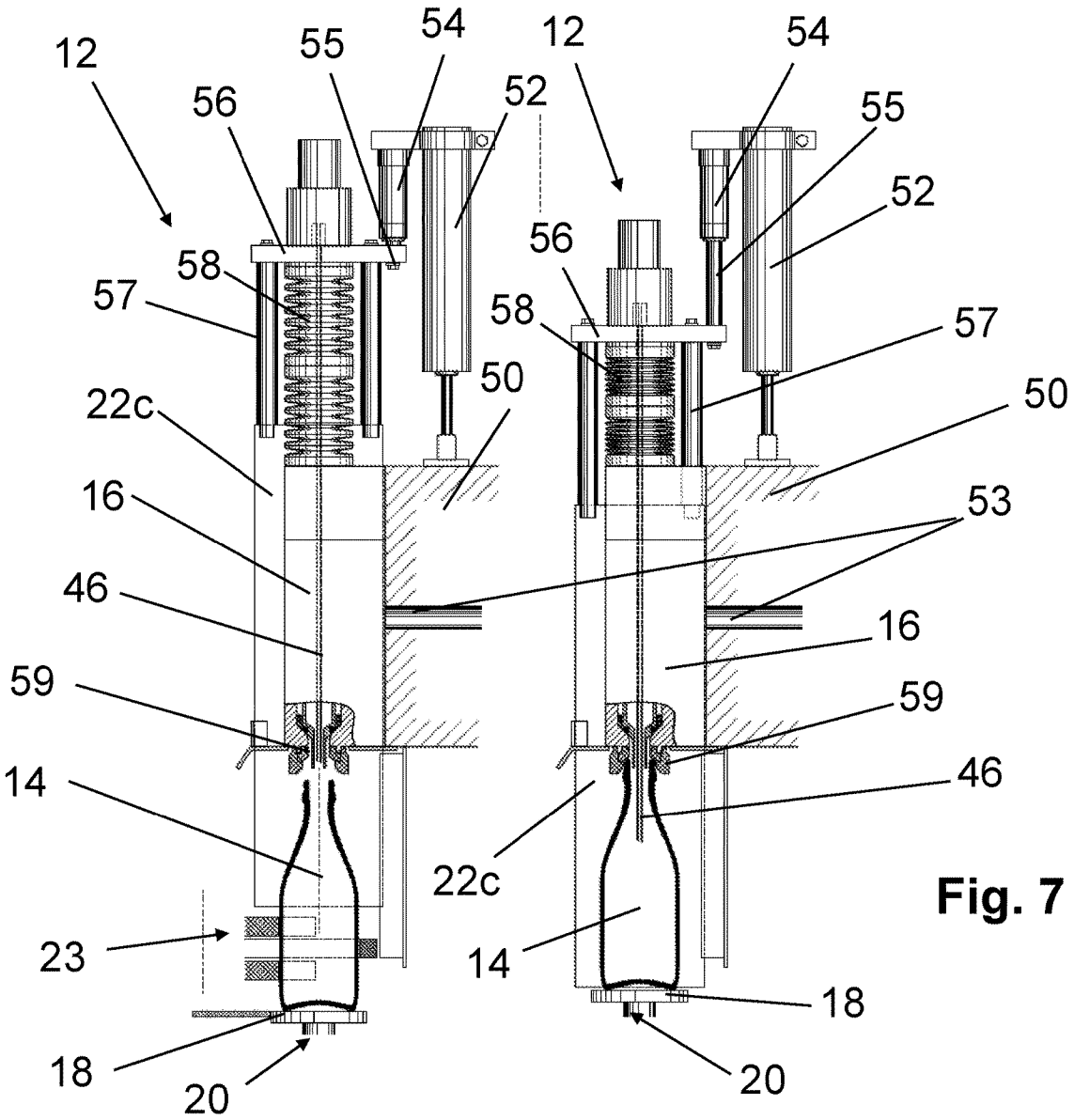
FIG. 7 shows another embodiment in which the partition plate couples to the lift for a return flow tube.

FIGS. 6 and 7 show further embodiments of receiving stations 12*a* such as those in the filling machine 10. In these embodiments, a return gas tube 46 determines filling height. In such an embodiment, first and second actuating cylinders 40, 42 control movement of the return gas tube 46 through the bottle's mouth.

In FIG. 6, a lower lift 49 adjusts the container receptacle 18. It does so by lifting the bottle 14 from below so that it presses against a sealing flange of the filling element 16. Actuating the lower lift 49 ensures simultaneous pressing and sealing of the bottle's mouth at the filling element's filling organ. By moving a bottle 14 from below and into the space between the partitions 22*b*, the lower lift 49 places the bottle 14 into a position in which it is optimally shielded.

The first actuating cylinder 40 lifts and lowers the second actuating cylinder 42. This second actuating cylinder 42 is held at the actuating piston 43 and couples to the partition 22*b*.

A helical spring 47 provides tension to hold a return gas tube's gas-tube holder 44 at the actuating piston 43. An upper first stop 41 and a lower first stop 45 bear against corresponding upper and lower ends of the helical spring 47. These limit its extension and compression. The partition 22 is secured to the lower end of the actuating piston 43.

A lower second stop 51 at the first actuating cylinder 40 limits the holding element's downward travel. The lower second stop's height depends on the first actuating cylinder's actuating height. As a result of interaction between the gas-tube holder 44 and the lower second stop 51, the lower second stop 51 also determines the maximum immersion depth of a return gas tube 46 into the bottle 14.

Before the lower lift 49 presses the bottle 14 against the filling element 16, the first and/or second actuating cylinder 40, 42 are actuated to avoid inserting the return gas tube 46 into the bottle 14 until after the bottle 14 has been sealed against the filling organ 59. Once this seal has formed, the first and second cylinders 40, 42 insert the return gas tube 46 into the container 14 to a depth that is appropriate for the desired filling height.

As a result of the foregoing operation, the lower lift 49 does not have to lift the bottle 14 with a stroke that exceeds the return gas tube's immersion length. The lower lift 49 thus presses the container 14 at the filling element's filling organ 59 with only a short stroke. In some cases, the short stroke is between ten and twenty-five millimeters. The first and second actuating cylinders 40, 42 thus form an adjusting mechanism that moves the partition 22*b* vertically upwards and downwards, independently of the actuation of the lower lift 49.

The first and second actuating cylinders 40, 42 move both the partition 22*b* and the return gas tube 46. The lower first stop 45 and the lower second stop 51 at the lower end of the first actuating cylinder 40 cooperate to limit the immersion depth of the return gas pipe 46 into the bottle 14.

The actuating piston 43 moves the partition 22*b* further downwards, against the force of the helical spring 47, as far as the position shown in for the right-hand container 14 in FIG. 6. In this position of maximum downward travel, the helical spring 47 is fully compressed. This represents the lowest position setting of the partition 22*b*.

The two left-hand containers 14 in FIG. 6 show positions with greater insertion depth. The greater insertion depth arises from an actuation setting that is located further downwards of the first actuating cylinder 40 and that corresponds to the second stop 51.

The two right-hand container 14 in FIG. 6 show the position of the first actuating cylinder 40 raised so as to reduce the return gas tube's maximum insertion depth. This results from the second stop 51 being located higher relative to the bottle 14.

In both the configurations shown on the left and right sides of FIG. 6, it remains possible to lower the partition 22*b* so that it almost reaches the container receptacle 18.

FIG. 7 shows an embodiment similar to that shown in FIG. 6. The left-hand portion of FIG. 7 shows a partition 22*c* in its release position while the right-hand portion shows the partition 22*c* in its protection position.

As was the case in FIG. 6, the filling element 16, is secured to a structural part 50 of the filling machine's rotation frame 17. A product delivery line 53 extends through the structural part 50 to the filling element 16.

The structural part 50 supports a first actuating cylinder 52 that moves a second actuating cylinder 52 up or down. A lower end of the second actuating cylinder 54 connects to an actuating piston 55. The lower end of the actuating piston 56 forms a carrier 56.

The carrier 56 holds the return gas tube 46. It also holds a vertical brace 57 that connects it to the partition 22*c*. Thus, unlike the embodiment shown in FIG. 6, the embodiment shown in FIG. 7 couples the motion of the partition 22*c* and the return gas tube 46. A plate-shaped bellows 58 extends between the carrier 56, which in particular is plate-shaped and the upper side of the filling element 16, thus forming a seal.

In the embodiment of FIG. 7, the first actuating cylinder 52 sets both the return gas tube's maximum insertion depth and the partition's lowest position. The second actuating cylinder 54 executes the strokes of the partition 22*c* and the return gas tube 46. The first and second actuating cylinders 52, 54 thereby form a position adjustment mechanism for the relative movement of the partition 22*c* and container receptacle 18. As was the case in the embodiment of FIG. 6, a lower lift 49 presses the bottle 14 against the filling element's filling organ 49.

Figure 8:
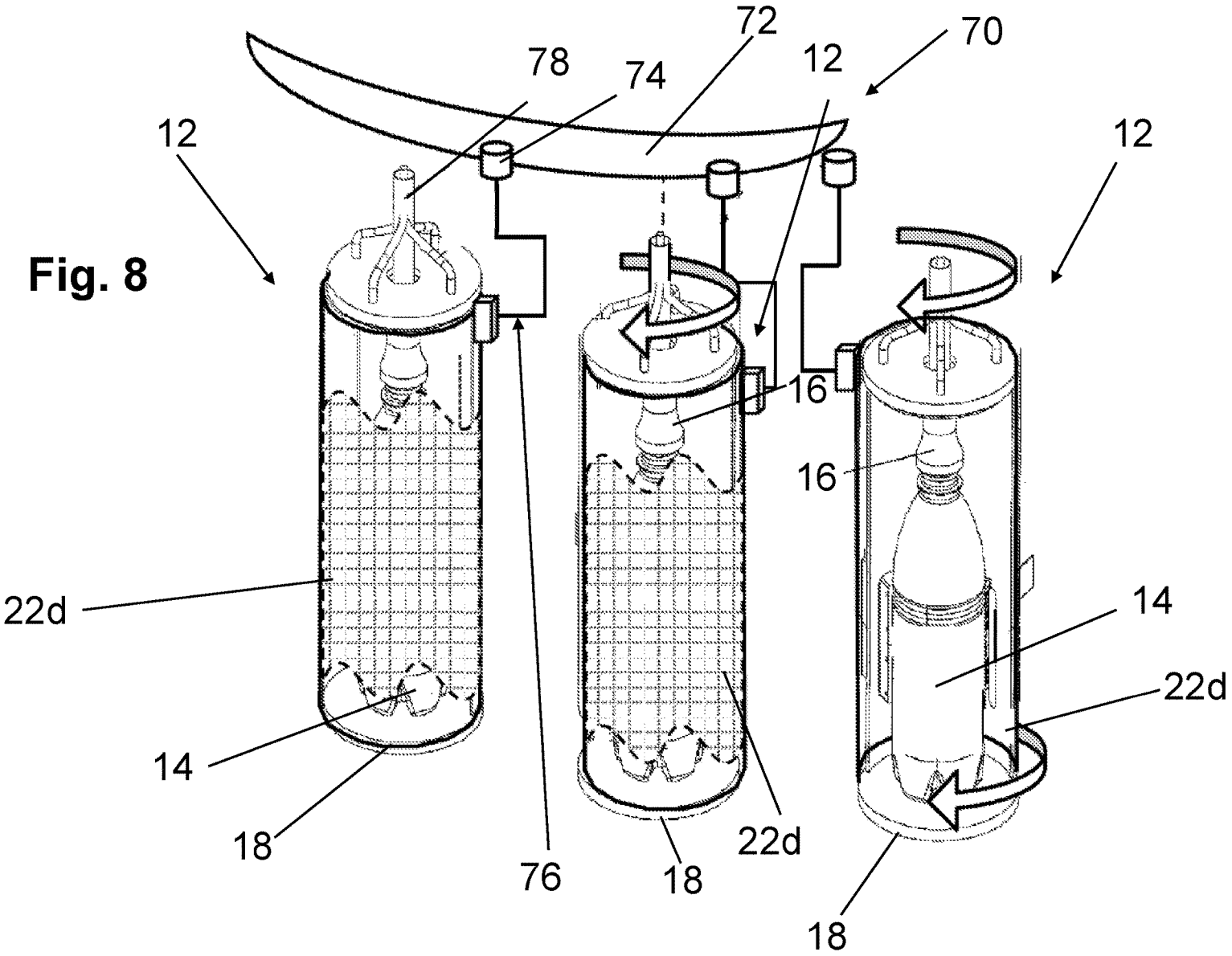
FIG. 8 shows an embodiment with a rotationally-moved partially cylindrical partition plate.

FIG. 8 shows an embodiment in which a rotator 70 rotates a rotationally-movable partition 22*d*. The rotator 70 features a fixed ramp 72 in the region of the feed-and-discharge device 23. Interaction of the ramp 23 with a guide 74 at the receiving stations 12 causes a rotation drive 76, 78 to turn the partition 22*d* from a protection position into a release position. In FIG. 8, the middle partition is in the protection position and the right-hand partition is in the release position.

In the embodiment of FIG. 8, the partition 22*d* is a semi-circular cylinder that surrounds the bottle 14 to an extent sufficient to shield adjacent bottles from flying shards should that bottle 14 burst. Preferably, the partition 22*d* surrounds an angular extent of the container 14 that is between 180° and 240°.

Having described the invention and a preferred embodiment thereof, what is claimed as new and secured by Letters Patent is:

1. An apparatus comprising a filling machine for pressure-filling containers, said filling machine comprising a rotating transport element that comprises receiving stations, each of which includes a filling element, a first lift, a shield, an adjuster, and a container receptacle for a container, said container receptacle being arranged beneath said filling element, wherein said first lift vertically adjusts said filling element in a vertical direction to accommodate different container sizes, wherein said shield, which is formed at said receiving station, is adjustable relative to said filling element and comprises a single-piece partition that defines at least a portion of a cylinder, wherein, during filling of said containers, said shield is in a protection position in which it at least partially surrounds said container, wherein said adjuster adjusts said shield and said container receptacle relative to one another between said protection position and a release position, wherein said adjuster adjusts said shield and said container receptacle relative to each other by changing a position of said container receptacle relative to said shield in a region of a feeding-and-discharge device, wherein said feeding-and-discharge device is arranged in a conveying region of said transport element for feeding said container to said transport element and for receiving a container that has been discharged from said rotating transport element, wherein said adjuster comprises at least one of a second lift and a rotation mechanism, and wherein said rotation mechanism rotates said container about a container axis thereof.

2. The apparatus of claim 1, wherein said adjuster comprises said second lift, wherein said second lift comprises a ramp in a region of said feeding-and-discharge device, and wherein said ramp interacts with a runner that connects to said container receptacle.

3. The apparatus of claim 1, further comprising a rotation mechanism, wherein said single-piece partition is a semi-circular cylinder, and wherein said rotation mechanism rotates said single-piece partition.

4. The apparatus of claim 1, wherein said adjuster comprises said second lift, wherein said second lift comprises an actuating cylinder, and wherein said actuating cylinder is configured to cause a change in the relative positions of said container receptacle and said shield.

5. The apparatus of claim 1, wherein said filling machine is a circular filling machine.

6. The apparatus of claim 1, wherein said single-piece partition surrounds a portion of a wall of a container on a side of said wall that faces radially outward from an axis of rotation of said rotating transport element.

7. The apparatus of claim 1, wherein said adjuster comprises said second lift and wherein said second lift comprises a linear drive.

8. The apparatus of claim 1, further comprising a return gas tube coupled to said second lift, wherein said second lift causes said return gas tube to move vertically with said shield.

9. The apparatus of claim 1, further comprising a return gas tube coupled to said second lift, wherein said second lift causes said return gas tube to move vertically with said container receptacle.

10. The apparatus of claim 1, further comprising a runner that connects to said container receptacle, wherein said second lift comprises a ramp that interacts with said runner in a region of said feeding-and-discharge device, and wherein said second lift is a constituent of said adjuster.

11. A method of using a filling machine for pressure-filling containers, said filling machine comprising a rotating transport element that comprises receiving stations, each of which includes a filling element, a first lift, a shield, an adjuster, and container receptacle for a container, said container receptacle being arranged beneath said filling element, wherein said first lift vertically adjusts said filling element in a vertical direction to accommodate different container sizes, wherein said shield, which is formed at said receiving station, is adjustable relative to said filling element and comprises a single-piece partition that defines at least a portion of a cylinder, and that is in a protection position in which it at least partially surrounds said container during filling thereof, wherein said adjuster adjusts said shield and said container receptacle relative to one another between a protection position into a release position by changing a position of said container receptacle relative to said shield in a region of a feeding-and-discharge device that is arranged in a conveying region of said transport element for feeding said container to said transport element and for receiving a container that has been discharged from said rotating transport element, and wherein said adjuster comprises at least one of a second lift and a rotation mechanism that rotates a container about a container axis thereof, wherein said method comprises using said filling machine to fill a container having a first size, adjusting said filling machine to accommodate a container having a second size that differs from said first size, and using said filling machine to fill said container having said second size, wherein adjusting said filling machine comprises adjusting a relative position of said shield relative to said filling element.

12. The method of claim 11, further comprising causing said shield to be in a shielding position while said container is being filled and causing said shield to be in a release position after said container has filled, wherein, in said shielding position, said shield at least partially surrounds said container, wherein causing said shield to be in said shielding position comprises causing relative movement between said shield and said container receptacle, wherein causing said relative movement comprises one of rotating said shield and said container receptacle relative to each other and causing vertical movement of said shield and said container receptacle relative to each other.

* * * * *